US010274146B2

(12) United States Patent
Lu et al.

(10) Patent No.: US 10,274,146 B2
(45) Date of Patent: Apr. 30, 2019

(54) LED CEILING LAMP

(71) Applicant: Xiamen PVTECH Co., Ltd., Xiamen, Fujian (CN)

(72) Inventors: Fuxing Lu, Fujian (CN); Ruicha Lai, Fujian (CN)

(73) Assignee: Xiamen PVTECH Co., Ltd., Xiamen, Fujian (CN)

( * ) Notice: Subject to any disclaimer, the term of this patent is extended or adjusted under 35 U.S.C. 154(b) by 0 days.

(21) Appl. No.: 15/792,734

(22) Filed: Oct. 24, 2017

(65) Prior Publication Data

US 2018/0119903 A1 May 3, 2018

(30) Foreign Application Priority Data

Nov. 1, 2016 (CN) ..... 2016 1 0933835

(51) Int. Cl.

| | |
|---|---|
| ***F21S 4/28*** | (2016.01) |
| ***F21V 15/01*** | (2006.01) |
| ***F21V 21/02*** | (2006.01) |
| *F21Y 105/10* | (2016.01) |
| *F21Y 115/10* | (2016.01) |
| *F21V 3/02* | (2006.01) |
| *F21V 15/015* | (2006.01) |
| *F21V 19/00* | (2006.01) |
| *F21V 23/00* | (2015.01) |
| *F21V 29/507* | (2015.01) |
| *F21V 29/89* | (2015.01) |

(52) U.S. Cl.

CPC ..... *F21S 4/28* (2016.01); *F21V 21/025* (2013.01); *F21V 3/02* (2013.01); *F21V 15/01* (2013.01); *F21V 15/015* (2013.01); *F21V 19/0045* (2013.01); *F21V 23/004* (2013.01); *F21V 29/507* (2015.01); *F21V 29/89* (2015.01); *F21Y 2105/10* (2016.08); *F21Y 2115/10* (2016.08)

(58) Field of Classification Search

CPC ..... F21S 4/28; F21Y 2115/10; F21V 15/01

See application file for complete search history.

(56) References Cited

U.S. PATENT DOCUMENTS

| | | | |
|---|---|---|---|
| D344,605 | S | 2/1994 | Aspenwall |
| D521,172 | S | 5/2006 | Chen |

(Continued)

OTHER PUBLICATIONS

Fuxing Lu et al., Title: LED Lamp, pending U.S. Appl. No. 29/596,370, filed Mar. 8, 2017.

*Primary Examiner* — Joseph L Williams

(74) *Attorney, Agent, or Firm* — Winston Hsu

(57) ABSTRACT

A LED ceiling lamp is provided. The LED ceiling lamp comprises: an elongated light cover; an elongated housing including a fastening slot and two side portions connected with the elongated light cover; a light source plate secured between the elongated light cover and the elongated housing; a power source seat electronically connected to the light source plate and being secured on the fastening slot; and two end covers connected with two ends of the elongated light cover and two ends of the elongated housing, respectively. The length of the LED ceiling lamp is various according to the requirement. The heat dissipation effect is well. The power can be designed according to requirements. The service life is long. The LED ceiling lamp is easily assembled and repaired. The light emitting rate is high. The light emitting efficiency of the power source is high.

10 Claims, 2 Drawing Sheets

(56) References Cited

U.S. PATENT DOCUMENTS

| | | | | |
|---|---|---|---|---|
| D574,093 | S | 7/2008 | Kitagawa | |
| D663,882 | S | 7/2012 | Muraishi | |
| D693,047 | S | 11/2013 | Haumann | |
| 8,591,057 | B2 * | 11/2013 | Kawabata | F21K 9/00 362/217.02 |
| D705,975 | S | 5/2014 | Hedstrom | |
| D706,480 | S | 6/2014 | Hedstrom | |
| 9,271,354 | B2 * | 2/2016 | Takahashi | H05B 33/0803 |
| D765,299 | S | 8/2016 | Ladnier | |
| D791,997 | S | 7/2017 | van den Dool | |
| 9,699,856 | B2 * | 7/2017 | Roberts | H05B 33/0854 |
| D800,367 | S | 10/2017 | Ladnier | |
| D805,235 | S | 12/2017 | Waldmann | |
| D806,926 | S | 1/2018 | Goetz-Schaefer | |
| 2014/0043801 | A1 * | 2/2014 | Kawabata | F21K 9/00 362/218 |
| 2015/0077001 | A1 * | 3/2015 | Takahashi | H05B 33/0803 315/193 |
| 2015/0247607 | A1 * | 9/2015 | Kawabata | F21K 9/00 362/218 |
| 2016/0290610 | A1 | 10/2016 | Skiba | |

* cited by examiner

LED CEILING LAMP

BACKGROUND OF THE INVENTION

1. Field of the Invention

The invention relates to a light-emitting diode (LED) ceiling lamp and, more particularly, relates to a LED ceiling lamp for a T5 tube which has good heat dissipation effect and is convenient to be assembled.

2. Description of the Prior Art

A fluorescent tube is a necessary and widely used lighting source. However, the fluorescent tube is large. Moreover, heavy mercury pollution is generated in manufacture, use and disposal processes, which is a potential heavy metal pollution source in the environmental protection. The service life of the fluorescent tube is very short, only about 1000 hours. Only ten percent of the received electric energy can be converted into light energy while ninety percent is converted into useless heat energy to be dissipated into the air. Obviously, the electric energy is wasteful, and the burden on the natural environment is heavy.

LED has a lot of advantages, such as environmental protection, electricity saving, high efficiency and long service life, small in size, fast in reaction and the like. As a result, to overcome the defects of the fluorescent tube and meet the requirements on the environmental protection, energy conservation, and emission reduction, LED tubes are developed to replace conventional fluorescent tubes. LED lamps are gradually used in various lighting fields. The Led lighting technology is regarded as a welcome light source in the 21 century. The Led lighting technology may replace conventional light sources and becomes to a mainstream illumination light source. LED ceiling lamps are also wildly used in daily life.

In recent years, the LED lighting technology is developed and widely used in daily life, for example, the field of information technology, communication technology, consumer electronics, and display devices. With the launch of the white light LED, LEDs are further developed as a new and potential light source. More acceptable products for consumers are also developed.

Conventionally, tubular lamps in the market include two types. According to one type, the elongated light cover is made of plastic, and a heat dissipation portion is made of aluminum. The LED plate is secured inside the elongated light cover and connected to the aluminum portion. The elongated light cover is secured in the aluminum portion. However, the LED tubular lamps of this type have many disadvantages. For example, the resistance to pressure is not enough, the requirement on a driving power source is high, the cost is high, and the safety performance is low. Thus, tubular lamps of this type usually cannot meet the requirement of users, and the practicability is not good enough. According to the other type, the whole tubular lamp is made of plastic, and the light plate is secured inside the plastic portion. The resistance to pressure is high, and the safety performance is good. However, the heat dissipation effect is poor, and the LED plate cannot be made in a large size. Moreover, the service life is short.

Additionally, the structure of the LED tubes in the market is too complex, and the disassembly is too difficult for users.

SUMMARY OF THE INVENTION

A LED ceiling lamp is provided. The LED ceiling lamp comprises: an elongated light cover; an elongated housing including a fastening slot and two side portions connected with the elongated light cover; a light source plate secured between the elongated light cover and the elongated housing; a power source seat electronically connected to the light source plate, the power source seat is secured on the fastening slot; and two end covers connected with two ends of the elongated light cover and two ends of the elongated housing, respectively.

In an embodiment, the LED ceiling lamp further includes at least a fixing member, and the elongated light cover and the elongated housing are fixed to the end covers via the fixing member.

In an embodiment, the LED ceiling lamp further comprises a buffing pad secured in a gap between the elongated housing and the two end covers.

In an embodiment, the light source plate is secured inside the elongated housing.

In an embodiment, the LED ceiling lamp further comprises at least a clamp unit which is a hollow shell.

In an embodiment, two side portions of the clamp unit are fastened with two side portions of the elongated housing.

In an embodiment, each of the two end covers is a hollow cover with one closed end and one open end.

In an embodiment, the elongated light cover is an arc-shaped hollow cover.

In an embodiment, the elongated light cover is made of polycarbonate.

In an embodiment, the elongated housing is made of aluminum.

In embodiments, the length of the LED ceiling lamp is various according to the requirement. The heat dissipation effect is well. The power can be designed according to requirements. The service life is long. The LED ceiling lamp is easily assembled and repaired. The light emitting rate is high. The light emitting efficiency of the power source is high.

BRIEF DESCRIPTION OF THE DRAWINGS

These and other features, aspects and advantages of the invention will become better understood with regard to the following embodiments and accompanying drawings.

DETAILED DESCRIPTION

Figure 1:
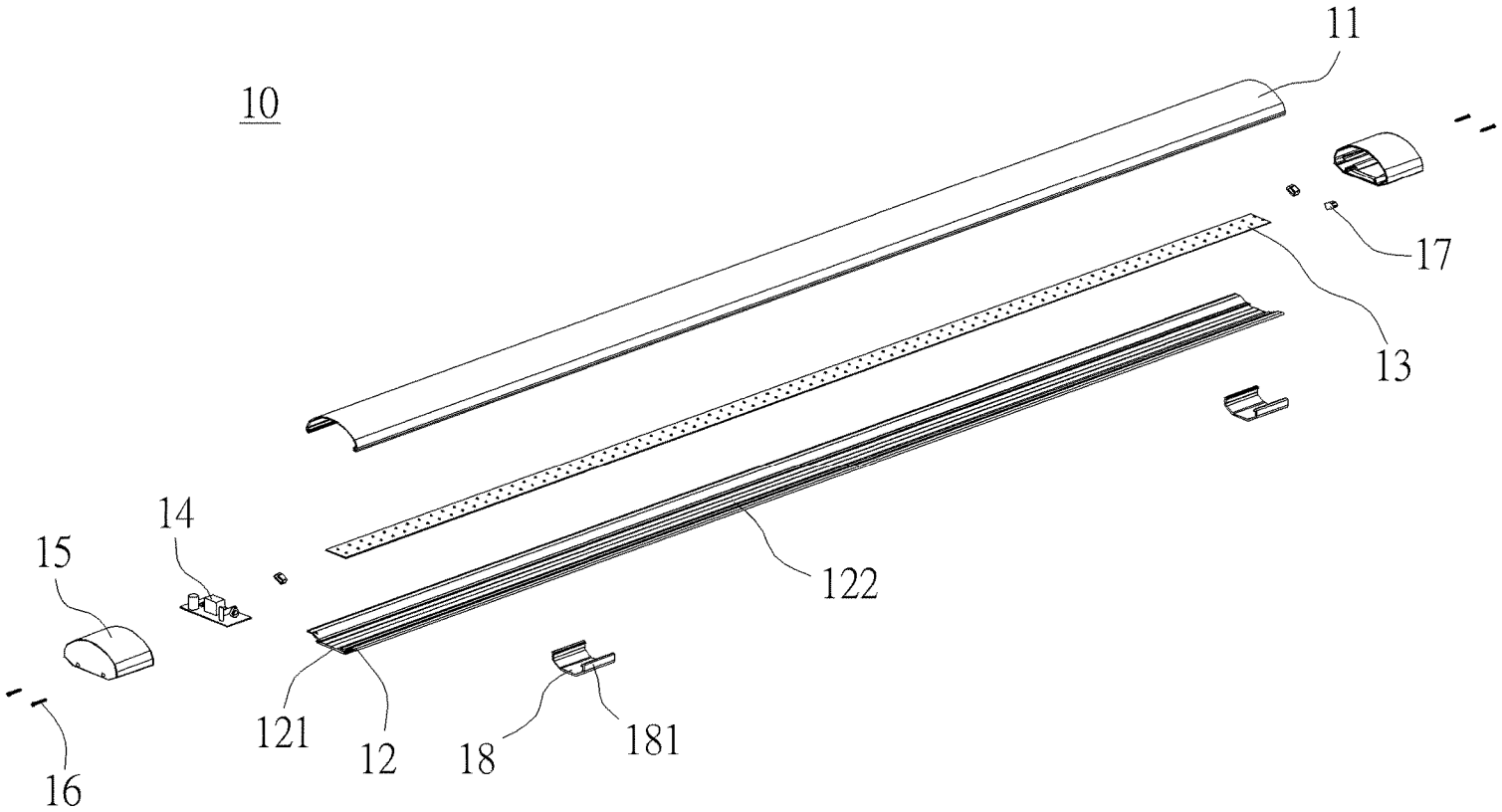
FIG. 1 is an explode diagram of a LED ceiling lamp in an embodiment.

FIG. 1 is an explode diagram of a LED ceiling lamp in an embodiment. As shown in FIG. 1, a LED ceiling lamp 10 includes an elongated light cover 11, an elongated housing 12, a light source plate 13, a power source seat 14, and two end covers 15.

The LED ceiling lamp 10 includes an elongated light cover 11 and an elongated housing 12. The elongated housing 12 includes a fastening slot 121. Two side portions of the elongated housing 12 are connected with the elongated light cover 11. The light source plate 13 is secured between the elongated light cover 11 and the elongated housing 12. The power source seat 14 is electronically connected to the light source plate 13. The power source seat 14 is secured on the fastening slot 121. Two end covers 15 are connected with two ends of the elongated light cover 11 and two ends of the elongated housing 12, respectively. One of the end covers 15 is connected with one end of the elongated light cover 11 and one end of the elongated housing 12, and the power source seat 14 is located in the end cover 15 connected with the elongated light cover 11 and the elongated housing 12.

In an embodiment, the elongated light cover 11 is made of light-transmitting plastic, such as polycarbonate (PC). That is, the elongated light cover 11 is a light-transmitting cover. In an embodiment, the elongated housing 12 is made of aluminum. The material of the elongated housing 12 and the elongated light cover 11 is various according to requirements and not limited herein. In an embodiment, the elongated light cover 11 is an arc-shaped hollow cover. The shape, the size, and the length of the elongated light cover 11 are various according to requirements and not limited herein. The elongated housing 12 and the elongated light cover 11 are assembled together to form a hollow tube by, but not limited to, screwing, fastening. Then, the elongated light cover 11 is detachably assembled to the elongated housing 12. Moreover, the assembled elongated light cover 11 and the elongated housing 12 are not easily deformed, detached, or fall off due to the gravity and the external force. The elongated light cover 11 covers the light source plate 13. In an embodiment, two or more LEDs are secured on the light source plate 13. The light of the LEDs is emitted out from the elongated light cover 11. The elongated housing 12 is fixed to a proper position via back adhesive, a clamping member and so on, which is not limited herein.

The elongated housing 12 has a heat dissipation function. In an embodiment, the elongated housing 12 is made of aluminum, which is not limited herein. The LEDs are arranged in one or more rows along the light source plate 13. The LEDs are electronically connected with the power source seat 14.

In an embodiment, the light source plate 13 may be a printed circuit board and is secured in the elongated housing 12. In an embodiment, first fastening portions 122 extend out of two side portions of the elongated housing 12, respectively. In an embodiment, the light source plate 13 may slide from one end of the tube to be assembled inside the elongated housing 12, the light source plate 13 is fixed in the elongated housing 12 via the first fastening portion 122 which clamps edges of the light source plate 13. With such, the light source plate 13 is not easily detached from the elongated housing 12.

In an embodiment, the LED ceiling lamp 10 further includes at least a fixing member 16. The elongated light cover 11 and the elongated housing 12 are fixed to the end covers 15 via the fixing member 16. In an embodiment, the fixing member 16 is a self-tapping screw, which is not limited herein. The LED ceiling lamp is easily replaced via the fixing member 16.

The end cover 15 is a hollow cover with one closed end and one open end. The end cover 15 further fixes the power source seat 14 via the fastening slot 121 of the elongated housing 12, and then the LED ceiling lamp 10 is more stable.

In an embodiment, the LED ceiling lamp 10 further includes a buffing pad 17. In an embodiment, the buffing pad 17 includes a rubber sheet. The buffing pad 17 is used to fill the gap between the elongated housing 12 and the end cover 15. Then, internal structure of the LED ceiling lamp 10 is more stable.

In an embodiment, the LED ceiling lamp 10 further includes a clamp unit 18. For example, the clamp unit 18 is a hollow shell. Second fastening members 181 extend outwardly from two side portions of the clamp unit 18, respectively. The second fastening member 181 of the clamp unit 18 is adapted to be fastened to the first fastening portion 122 secured in two side portions of the elongated housing, which is easily to be assembled and repaired.

Figure 2:
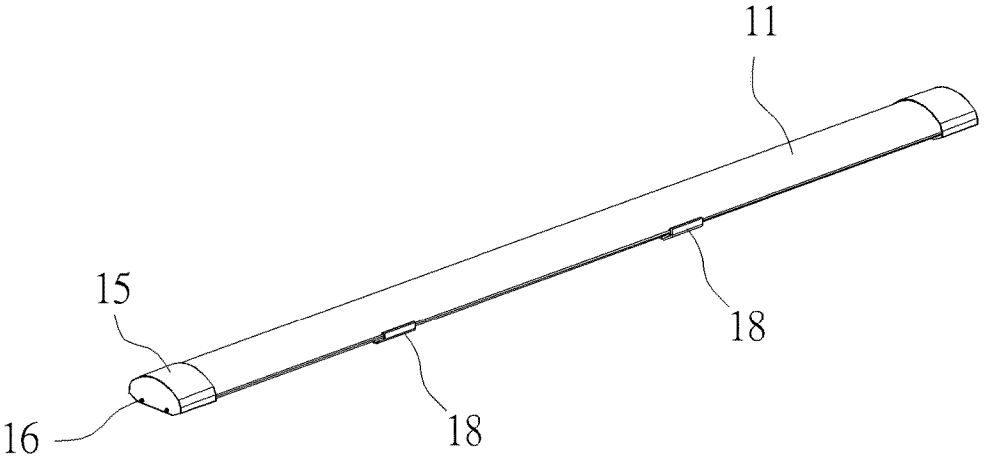
FIG. 2 is a schematic diagram showing an exterior of a LED ceiling lamp in an embodiment.

FIG. 2 is a schematic diagram showing an exterior of a LED ceiling lamp in an embodiment. As shown in FIG. 2, in an embodiment, the exterior of a LED ceiling lamp is formed after the components in FIG. 1 are assembled. The length of the LED ceiling lamp is various according to the requirement. The heat dissipation effect is well. The power can be designed according to requirements. The service life is long. The LED ceiling lamp is easily to be assembled and repaired. The light emitting rate is high, and the light emitting efficiency of the power source is high. The product has high practicability.

Although the invention has been disclosed with reference to certain embodiments thereof, the disclosure is not for limiting the scope. Persons having ordinary skill in the art may make various modifications and changes without departing from the scope of the invention. Therefore, the scope of the appended claims should not be limited to the description of the embodiments described above.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light-emitting diode (LED) ceiling lamp, comprising:

an elongated light cover;

an elongated housing including a fastening slot and two side portions connected with the elongated light cover;

a light source plate secured between the elongated light cover and the elongated housing;

a power source seat electronically connected to the light source plate and being secured on the fastening slot; and two end covers connected with two ends of the elongated light cover and two ends of the elongated housing, respectively, wherein one of the end covers is connected with one end of the elongated light cover and one end of the elongated housing, and the power source seat is located in the end cover connected with the elongated light cover and the elongated housing.

2. The LED ceiling lamp according to claim 1, wherein the LED ceiling lamp further includes at least a fixing member, and the elongated light cover and the elongated housing are fixed to the end covers via the fixing member.

3. The LED ceiling lamp according to claim 1, further comprising a buffing pad secured in a gap between the elongated housing and the two end covers.

4. The LED ceiling lamp according to claim 1, wherein the light source plate is secured inside the elongated housing.

5. The LED ceiling lamp according to claim 1, further comprising at least a clamp unit which is a hollow shell.

6. The LED ceiling lamp according to claim 5, wherein two side portions of the clamp unit are fastened with two side portions of the elongated housing.

7. The LED ceiling lamp according to claim 1, wherein each of the two end covers is a hollow cover with one closed end and one open end.

8. The LED ceiling lamp according to claim 1, wherein the elongated light cover is an arc-shaped hollow cover.

9. The LED ceiling lamp according to claim 1, wherein the elongated light cover is made of polycarbonate.

10. The LED ceiling lamp according to claim 1, wherein the elongated housing is made of aluminum.

* * * * *